US012753352B2

(12) United States Patent
Cuoq et al.

(10) Patent No.: US 12,753,352 B2
(45) Date of Patent: Oct. 6, 2026

(54) SYSTEMS AND METHODS FOR REMOVAL OF HALOGENATED CONTAMINANTS FROM PYROLYSIS OIL BY INERT GAS PURGING

(71) Applicant: SABIC Global Technologies B.V., Bergen OP Zoom (NL)

(72) Inventors: Fabrice Cuoq, Geleen (NL); Martijn Marcel Margaret Frissen, Geleen (NL); Carlo Jozef Maria Geijselaers, Geleen (NL); Kae Wong, Geleen (NL)

(73) Assignee: SABIC Global Technologies B.V., Bergen op Zoom (NL)

( * ) Notice: Subject to any disclaimer, the term of this patent is extended or adjusted under 35 U.S.C. 154(b) by 253 days.

(21) Appl. No.: 18/710,456

(22) PCT Filed: Nov. 23, 2022

(86) PCT No.: PCT/IB2022/061356

§ 371 (c)(1),
(2) Date: May 15, 2024

(87) PCT Pub. No.: WO2023/095035

PCT Pub. Date: Jun. 1, 2023

(65) Prior Publication Data

US 2025/0002795 A1 Jan. 2, 2025

Related U.S. Application Data

(60) Provisional application No. 63/264,478, filed on Nov. 23, 2021.

(51) Int. Cl.
*C10G 53/08* (2006.01)
*C10G 53/04* (2006.01)

(52) U.S. Cl.
CPC ..... *C10G 53/08* (2013.01); *C10G 53/04* (2013.01); *C10G 2300/202* (2013.01); *C10G 2300/4081* (2013.01)

(58) Field of Classification Search
CPC .. C10G 53/08; C10G 53/04; C10G 2300/202; C10G 2300/4081; C10G 1/10;
(Continued)

(56) References Cited

U.S. PATENT DOCUMENTS 4,180,457 A 12/1979 Popp et al.
4,234,388 A 11/1980 Mallan et al.
(Continued)

FOREIGN PATENT DOCUMENTS

CN 106590702 B 10/2017
CN 108517223 A 9/2018
(Continued)

OTHER PUBLICATIONS

International Search Report for international application No. PCT/IB2022/061356, mailed on Feb. 8, 2023.

*Primary Examiner* — Ellen M McAvoy
*Assistant Examiner* — Chantel Graham
(74) *Attorney, Agent, or Firm* — Womble Bond Dickinson (US) LLP

(57) ABSTRACT

Provided here are methods and systems for converting pyrolysis oil with halogenated contaminants to a substantially halogen-free pyrolysis oil by treatment with an inert gas.

20 Claims, 7 Drawing Sheets

(58) Field of Classification Search
CPC ..... C10G 31/08; C10G 53/02; C10G 31/00; B01D 53/04; B01D 53/14; B01D 2257/204; B01D 2257/206; B01D 2257/2064; B01D 53/68
See application file for complete search history.

(56) References Cited

U.S. PATENT DOCUMENTS

| | | | | |
|---|---|---|---|---|
| 5,656,151 | A * | 8/1997 | McLaughlin | C10G 31/08 208/DIG. 1 |
| 10,106,750 | B2 | 10/2018 | Gutierrez et al. | |
| 10,131,847 | B2 | 11/2018 | McNamara et al. | |
| 10,717,936 | B2 | 7/2020 | Stanislaus et al. | |
| 10,829,696 | B2 | 11/2020 | Javeed et al. | |
| 2012/0215043 | A1* | 8/2012 | Gaffney | B01J 37/06 502/64 |
| 2016/0264874 | A1 | 9/2016 | Narayanaswamy et al. | |
| 2016/0264885 | A1 | 9/2016 | Narayanaswamy et al. | |
| 2018/0371333 | A1 | 12/2018 | Waldron et al. | |
| 2019/0270939 | A1* | 9/2019 | Javeed | C10G 1/002 |

FOREIGN PATENT DOCUMENTS

| | | | |
|---|---|---|---|
| CN | 109563414 | A | 4/2019 |
| JP | H0995678 | A | 4/1997 |
| JP | 2002035159 | A | 2/2002 |
| WO | 2018025103 | A1 | 2/2018 |
| WO | 2020178597 | | 9/2020 |
| WO | 2020239729 | | 12/2020 |
| WO | 2020242912 | | 12/2020 |
| WO | 2021087059 | | 5/2021 |
| WO | 2021204818 | | 10/2021 |
| WO | 2021211521 | | 10/2021 |

* cited by examiner

SYSTEMS AND METHODS FOR REMOVAL OF HALOGENATED CONTAMINANTS FROM PYROLYSIS OIL BY INERT GAS PURGING

CROSS-REFERENCE TO RELATED APPLICATIONS

This application is a U.S. National Phase Under 35 U.S.C. § 371 of International Application No. PCT/IB2022/061356, titled "SYSTEMS AND METHODS FOR REMOVAL OF HALOGENATED CONTAMINANTS FROM PYROLYSIS OIL BY INERT GAS PURGING," filed Nov. 23, 2022, which claims the benefit of and priority to U.S. Provisional Application No. 63/264,478, filed on Nov. 23, 2021, all of which are incorporated herein by reference in their entireties.

TECHNICAL FIELD

The present disclosure generally relates to systems and methods for removing halogenated contaminants from pyrolysis oils. More specifically, the present disclosure relates to systems and methods for removing halogenated contaminants from pyrolysis oils in storage vessels by passing an inert gas stream through the storage vessel headspace or by bubbling the inert gas stream through the pyrolysis oil.

BACKGROUND

Mixed plastic waste is an opportunity feed that can be used to make hydrocarbonaceous products, like pyrolysis oil or synthetic crude oil. The mixed plastic waste is depolymerized to yield a liquid product, which can be processed by crackers and other refinery units. This chemical recycling route is emerging as an alternative to conventional mechanical recycling or incineration.

One challenge for using mixed plastic waste as a feedstock is the presence of halogenated polymers or formulated plastics, which contain halogen, sulfur, nitrogen, and oxygen containing compounds as additives. The chemical recycling of these materials can result in the presence of halogen, sulfur, nitrogen, and oxygen containing compounds as contaminants in the pyrolysis oil products. These contaminants can contribute to fouling and corrosion during the cracking of the contaminated pyrolysis oils; thus, limiting the amount of contaminated pyrolysis oils that can be processed in large processing units, such as fluid catalytic cracking, steam crackers, and refinery units. It would be desirable to remove the halogen, sulfur, nitrogen, and oxygen compound contaminants in a simple, cost effective manner that is scalable to commercial refinery volumes.

SUMMARY

To address these shortcomings in the art, Applicant has developed systems and methods for removing halogenated contaminants from pyrolysis oil. In certain embodiments, the method of treating pyrolysis oil to remove halogenated contaminants includes the steps of supplying an inert gas stream to a storage vessel containing a pyrolysis oil with halogenated contaminants to produce a halogen-enriched inert gas stream and a first dehalogenated pyrolysis oil containing at least twenty weight percent less of the halogenated contaminants as compared to the pyrolysis oil, conveying the first dehalogenated pyrolysis oil and water to a reactor equipped with a mixing element and mixing the first dehalogenated pyrolysis oil and water in the reactor to produce a halogen-enriched water stream and a second dehalogenated pyrolysis oil containing at least twenty weight percent less of the halogenated contaminants as compared to the first dehalogenated pyrolysis oil, and separating the halogen-enriched water stream from the second dehalogenated pyrolysis oil to produce a substantially halogen-free pyrolysis oil. The pyrolysis oil is treated with the inert gas in the absence of any catalyst in the storage vessel.

In certain embodiments, the storage vessel is maintained at ambient temperature. In certain embodiments, the inert gas stream contains nitrogen, argon, helium, or combinations thereof. In certain embodiments, the inert gas stream is supplied to a headspace above the pyrolysis oil or bubbled through the pyrolysis oil in the storage vessel.

In certain embodiments, the method further includes the steps of conveying the halogen-enriched inert gas stream to a halogen scrubbing unit to remove the halogenated contaminants by absorption, recovering the hydrocarbons present in the halogen-enriched inert gas stream, and recycling the hydrocarbons to the storage vessel containing the pyrolysis oil.

In certain embodiments, the method further includes the steps of supplying the halogen-enriched water stream to a water treatment unit to remove the halogenated contaminants and produce a substantially halogen-free water stream and second dehalogenated pyrolysis oil, recycling the substantially halogen-free water stream to the reactor, and contacting the second dehalogenated pyrolysis oil with an adsorbent to produce the substantially halogen-free pyrolysis oil. The adsorbent can be one or more of an activated carbon, an aluminosilicate, a solid acid, or a cationic exchange resin.

Embodiments also include systems of treating pyrolysis oil to remove halogenated contaminants. One such system includes a storage vessel containing a pyrolysis oil with halogenated contaminants and equipped with a first inlet for receiving an inert gas stream, a first outlet for discharging a halogen-enriched inert gas stream, a second outlet connected to and in fluid communication with a second inlet of a reactor. The halogen-enriched inert gas stream is produced along with a first dehalogenated pyrolysis oil from interactions between the inert gas stream and the pyrolysis oil. The first dehalogenated pyrolysis oil contains at least twenty weight percent less of the halogenated contaminants as compared to the pyrolysis oil. The system further includes the reactor equipped with a second inlet connected to and in fluid communication with the second outlet to receive the first dehalogenated pyrolysis oil, a third inlet to receive a water stream, a mixing element to mix the first dehalogenated pyrolysis oil and the water, and a third outlet connected to and in fluid communication with a fourth inlet of a separator. The system further includes the separator equipped with a fourth inlet that is connected to and in fluid communication with the third outlet to receive the mixture of the first dehalogenated pyrolysis oil and water. In certain embodiments, the separator is operated to separate a halogen-enriched water stream and a second dehalogenated pyrolysis oil that contains at least twenty weight percent less of the halogenated contaminants as compared to the first dehalogenated pyrolysis oil.

In certain embodiments, the storage vessel is maintained at ambient temperature. The inert gas stream contains one or more of nitrogen, argon, helium, or combinations thereof.

The first inlet can be positioned in the storage vessel to receive the inert gas at a headspace above the pyrolysis oil in the storage vessel, or the first inlet can be positioned proximal to the floor of the storage vessel to pass the inert gas through the pyrolysis oil in the storage vessel.

In certain embodiments, the system includes a halogen scrubbing unit with a fifth inlet connected to and in fluid communication with the first outlet of the storage vessel to receive the halogen-enriched inert gas stream. The halogen scrubbing unit is operated to remove the halogenated contaminants from the halogen-enriched inert gas stream by absorption. In certain embodiments, the system includes the halogen scrubbing unit equipped with a fourth outlet connected to and in fluid communication with a sixth inlet of the storage vessel to deliver the recovered hydrocarbons from the halogen-enriched inert gas stream to the storage vessel containing the pyrolysis oil.

In certain embodiments, the system includes an adsorbent-containing unit equipped with a seventh inlet connected to and in fluid communication with a fifth outlet of the separator. This adsorbent-containing unit is operated to further remove the halogenated contaminants from the second dehalogenated pyrolysis oil and to produce a substantially halogen-free pyrolysis oil. This adsorbent can be one or more of an activated carbon, an aluminosilicate, a solid acid, a silica-based material, or a cationic exchange resin.

In certain embodiments, the system includes a water treatment unit equipped with an eighth inlet connected to and in fluid communication with a sixth outlet of the separator. This water treatment unit is operated to remove the halogenated contaminants from the halogen-enriched water stream and produce a substantially halogen-free water stream. In certain embodiments, the water treatment unit is equipped with a seventh outlet that is connected to and in fluid communication with the ninth outlet of the reactor to recycle the substantially halogen-free water stream.

Still other aspects and advantages of these exemplary embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than may be necessary for a fundamental understanding of the embodiments discussed herein and the various ways in which they may be practiced. According to common practice, the various features of the drawings discussed below are not necessarily drawn to scale. Dimensions of various features and elements in the drawings may be expanded or reduced to more clearly illustrate embodiments of the disclosure.

DETAILED DESCRIPTION

Figure 1:
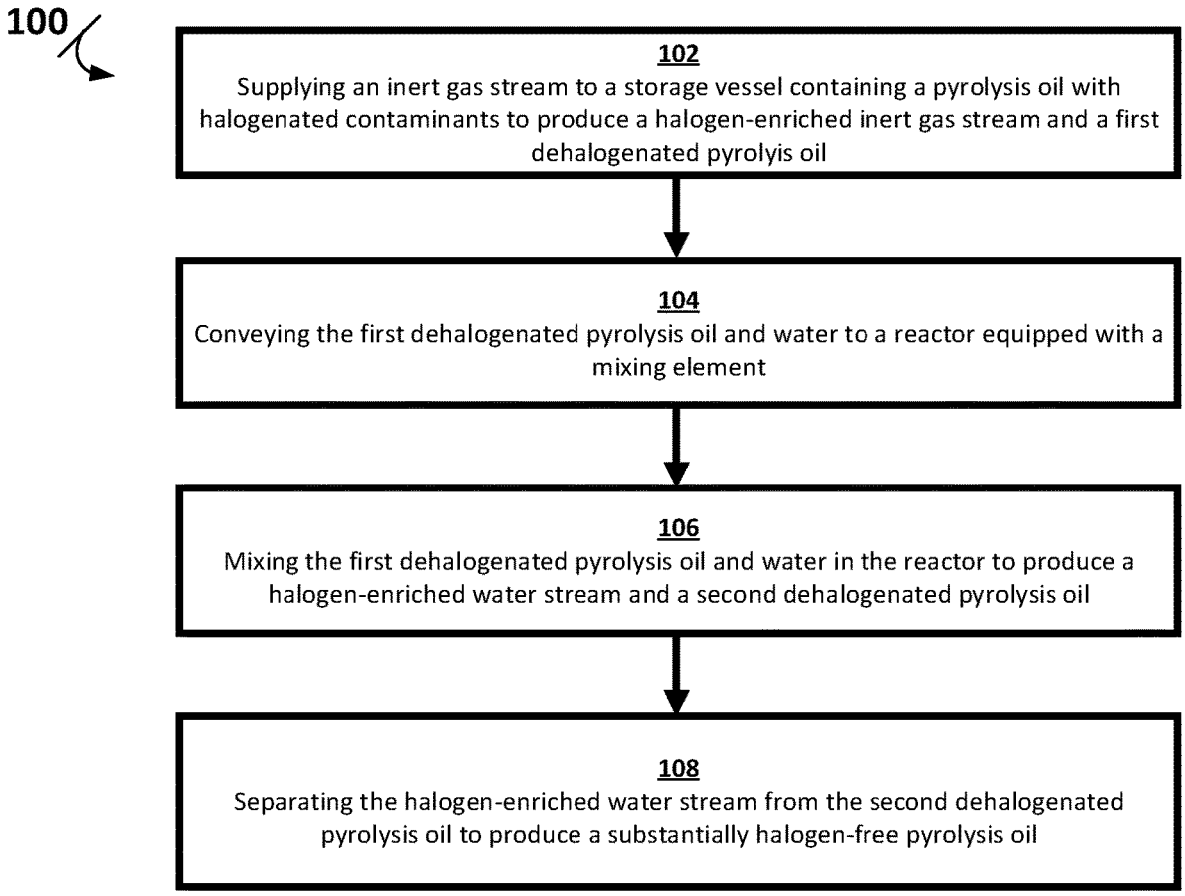
FIG. 1 is a diagrammatic representation of a method of treating pyrolysis oil to remove halogenated contaminants by supplying an inert gas stream to pyrolysis oil in a storage vessel, followed by water treatment of the pyrolysis oil in a reactor to produce a substantially halogen-free pyrolysis oil.

The present disclosure describes various embodiments related to processes, devices, and systems for converting pyrolysis oil with halogenated contaminants to a substantially halogen-free pyrolysis oil. More specifically, the present disclosure relates to systems and methods for converting pyrolysis oil with halogenated contaminants to a substantially halogen-free pyrolysis oil that is usable for a cracking unit or other refinery unit. Further embodiments may be described and disclosed. In the following description, numerous details are set forth in order to provide a thorough understanding of the various embodiments. In other instances, well-known processes, devices, and systems may not have been described in particular detail in order not to unnecessarily obscure the various embodiments. Additionally, illustrations of the various embodiments may omit certain features or details in order to not obscure the various embodiments.

The description may use the phrases "in certain embodiments," "in various embodiments," "in an embodiment," or "in embodiments," which may each refer to one or more of the same or different embodiments. Furthermore, the terms "comprising," "including," "having," and the like, as used with respect to embodiments of the present disclosure, are synonymous. The term "about" is defined as being close to as understood by one of ordinary skill in the art. In one non-limiting embodiment, the terms are defined to be within 10%, preferably within 5%, more preferably within 1%, and most preferably within 0.5%.

The terms "removing," "removed," "reducing," "reduced," or any variation thereof, when used in the claims and/or the specification includes any measurable decrease of one or more components in a mixture to achieve a desired result. The use of the words "a" or "an" when used in conjunction with any of the terms "comprising," "including," "containing," or "having," in the claims or the specification may mean "one," but it is also consistent with the meaning of "one or more," "at least one," and "one or more than one." The terms "wt. %", "vol. %", or "mol. %" refers to a weight, volume, or molar percentage of a component, respectively, based on the total weight, the total volume of material, or total moles, that includes the component. In a non-limiting example, 10 grams of component in 100 grams of the material is 10 wt. % of component. In various aspects, "substantially free" can include a composition that is about 95%, 96%, 97%, 98%, 99%, 99.9%, or 99.99% free of a component. In certain embodiments, when a composition is substantially free of a particular component, the composition contains less than 500 ppm, 400 ppm, 300 ppm, 200 ppm, or 100 ppm of that component. In certain embodiments, when a composition is substantially free of a particular component, the composition contains less than 90 ppm, 80 ppm, 70 ppm, 60 ppm, or 50 ppm of that component.

Embodiments include methods of treating pyrolysis oil to remove halogenated contaminants. Mixed plastic waste can contain small amounts of halogenated polymers such as polyvinyl chloride and fluoropolymers as well as formulated plastics containing brominated plasticizers and halogenated flame retardants as additives. The conditions of mixed plastic waste depolymerization to produce pyrolysis oil can liberate and entrain halogenated compounds in the pyrolysis oil as contaminants. One such method includes supplying an inert gas stream to a storage vessel containing a pyrolysis oil with halogenated contaminants to produce a halogen-enriched inert gas stream and a first dehalogenated pyrolysis oil. The pyrolysis oil is treated with the inert gas in the absence of any catalyst in the storage vessel. The removal of contaminants by passing gas through the liquid pyrolysis oil is driven by the gas flow rate, duration of gas flow, volatility of the contaminants, and the extent of the gas liquid interface. In certain embodiments, the introduction of inert gas to the liquid can be in the form of finely dispersed gas bubbles with a high gas liquid interface by passing the gas through sparging equipment, such as nozzles, rings, heads, pipes, porous sparger elements, or any combinations thereof. In certain embodiments, the inert gas is passed through the headspace above the liquid pyrolysis oil to sweep the halogenated contaminants from the storage vessel. In this step, at least twenty weight percent of the halogenated contaminants present in the pyrolysis oil are removed. In this step, at least forty weight percent of the halogenated contaminants present in the pyrolysis oil are removed. In this step, at least sixty weight percent of the halogenated contaminants present in the pyrolysis oil are removed. In certain embodiments, the storage vessel is maintained at ambient temperature.

In certain embodiments, the inert gas stream contains nitrogen, argon, helium, or combinations thereof. In certain embodiments, the gas flow rate is a range from 1 to 5 liters per minute. In certain embodiments, the gas flow rate is a range from 0.05 to 3 liters per minute. In certain embodiments, the gas flow rate is a range from 0.10 to 1.5 liters per minute. The gas flow rate is dependent on the amount to pyrolysis oil in the vessel and the dimensions and design of the storage vessel. In certain embodiments, the amount of nitrogen purged is about 10 liters per square meter to about 400 $L/m^2$.

The method can further include conveying the first dehalogenated pyrolysis oil, along with water, to a reactor equipped with a mixing element. In some embodiments, instead of water, the first dehalogenated pyrolysis oil can be treated with an aqueous alkaline solution. The first dehalogenated pyrolysis oil and water are mixed to produce a halogen-enriched water stream and a second dehalogenated pyrolysis oil. In this step, at least twenty weight percent of the halogenated contaminants present in the first dehalogenated pyrolysis oil are removed. In this step, at least thirty weight percent of the halogenated contaminants present in the first dehalogenated pyrolysis oil are removed. In this step, at least forty weight percent of the halogenated contaminants present in the pyrolysis oil are removed. In this step, at least sixty weight percent of the halogenated contaminants present in the pyrolysis oil are removed. In certain embodiments, the mixing element is one or more of an agitator, an impeller, a baffle, or a draft tube configured within the reactor to provide effective mixing of the first dehalogenated pyrolysis oil and water. In certain embodiments, the impeller is one of three types such as a propeller, paddle, or turbine, which generate either axial or radial flow of the fluids within the reactor. In certain embodiments, the halogen-enriched water stream is separated from the second dehalogenated pyrolysis oil in a separator to produce a substantially halogen-free pyrolysis oil. In certain embodiments, the phase separated halogen-enriched water phase and the second dehalogenated pyrolysis oil phase can be selectively removed from the reactor. In certain embodiments, the separator can be vertically or horizontally arranged to separate two or three phases. In certain embodiments, the separator can use momentive, gravity settling, or coalescing mechanisms for separating the halogen-enriched water phase and second dehalogenated pyrolysis oil phase.

In certain embodiments, the method further includes conveying the halogen-enriched inert gas stream to a halogen scrubbing unit to remove the halogenated contaminants, both organic and inorganic chlorides, by absorption. In certain embodiments, the halogen scrubbing unit is a neutralizing wet scrubber, an ion-exchange bed, an adsorbent bed (such as activated coal, silica-based, or aluminosilicates), or a packed tower scrubber. In certain embodiments, the method further includes recovering hydrocarbons present in the halogen-enriched inert gas stream and recycling the hydrocarbons to the storage vessel containing the pyrolysis oil. In certain embodiments, the hydrocarbons are volatilized low boiling paraffins, olefins, naphthenes or aromatics or any combination thereof.

In certain embodiments, the method further includes supplying the halogen-enriched water stream from the separator or reactor to a water treatment unit to remove the halogenated contaminants. In certain embodiments, the water treatment is an alkali bath, or adsorbent bed where the adsorbent is an activated carbon, an aluminosilicate, a solid acid, or a cationic exchange resin. The water treatment unit can also be a wet air oxidation system, an ozone treatment or a bio-waste water treatment system or a membrane unit. The substantially halogen-free water can be recycled to the reactor.

In certain embodiments, the second dehalogenated pyrolysis oil can be treated with an adsorbent to remove additional contaminants. In certain embodiments, the adsorbent is one or more of an activated carbon, an aluminosilicate, a solid acid, a silica-based material, or a cationic exchange resin.

FIG. 1 is a diagrammatic representation of a method 100 of treating pyrolysis oil to remove halogenated contaminants by supplying an inert gas stream to contaminated pyrolysis oil in a storage vessel, followed by water treatment of the contaminated pyrolysis oil in a reactor to produce a substantially halogen-free pyrolysis oil. This method 100 includes a step 102 of supplying an inert gas stream to a storage vessel containing a pyrolysis oil with halogenated contaminants to produce a halogen-enriched inert gas stream and a first dehalogenated pyrolysis oil. The first dehalogenated pyrolysis oil contains at least twenty weight percent less of the halogenated contaminants as compared to the unstripped contaminated pyrolysis oil. In an embodiment, the storage vessel is maintained at ambient temperature. In an embodiment, the inert gas stream contains nitrogen, argon, helium, or combinations thereof. In certain embodiments, the inert gas is supplied to a headspace above the pyrolysis oil in the storage vessel. In certain embodiments, the inert gas is bubbled through the pyrolysis oil in the storage vessel. In certain embodiments, the method further includes the step of conveying the halogen-enriched inert gas stream to a halogen scrubbing unit to remove the halogenated contaminants by absorption. In certain embodiments, the recovered hydrocarbons from the halogen scrubbing unit are recycled to the storage vessel containing the pyrolysis oil.

The method contains a further step 104 of conveying the first dehalogenated pyrolysis oil and water to a reactor equipped with a mixing element. The first dehalogenated pyrolysis oil and water are mixed 106 in the reactor to produce a halogen-enriched water stream and a second dehalogenated pyrolysis oil. In certain embodiments, the halogen-enriched water stream is supplied to a water treatment unit to remove the halogenated contaminants and produce a substantially halogen-free water. In a specific embodiment, the substantially halogen-free water stream is recycled to the reactor.

The method contains a further step 108 of separating the halogen-enriched water stream from the second dehalogenated pyrolysis oil to produce a substantially halogen-free pyrolysis oil. In certain embodiments, the second dehalogenated pyrolysis oil is further contacted with an adsorbent to produce a substantially halogen-free pyrolysis oil. In certain embodiments, the adsorbent is an activated carbon, an aluminosilicate, a solid acid, or a cationic exchange resin.

Figure 2:
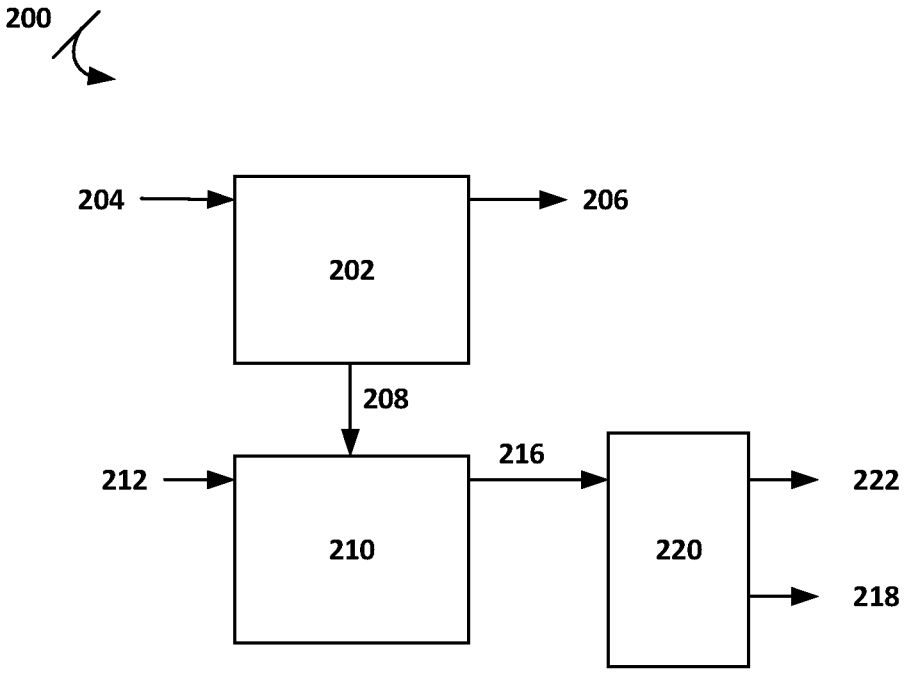
FIG. 2 is a diagrammatic representation of a system to treat pyrolysis oil containing halogenated contaminants, which includes a storage vessel, a reactor, and a separator to produce a substantially halogen-free pyrolysis oil.

Embodiments also include systems of treating pyrolysis oil to remove halogenated contaminants. FIG. 2 is a diagrammatic representation of a system 200 to treat halogen contaminated pyrolysis oil. This system 200 includes a storage vessel 202 equipped to receive an inert gas stream 204 and a halogen contaminated pyrolysis oil. The storage vessel 202 has a first inlet, a first outlet, a second outlet, and a sixth inlet. The first inlet has an opening to receive therethrough the inert gas stream 204. The first inlet of the storage vessel can be configured to pass inert gas through the headspace above the pyrolysis oil. The first inlet of the storage vessel can be alternatively configured to bubble inert gas stream 204 through the liquid pyrolysis oil. The first outlet of the storage vessel 202 is configured to discharge the halogen enriched inert gas stream 206. The second outlet of the storage vessel 202 is configured to discharge the first dehalogenated pyrolysis oil 208 to a reactor 210. The first dehalogenated pyrolysis oil 208 contains at least twenty weight percent less of the halogenated contaminants as compared to the unstripped contaminated pyrolysis oil. In certain embodiments, the storage vessel 202 is maintained at ambient temperature. The reactor 210 has a second inlet, third inlet and third outlet. The reactor 210 has a second inlet connected to and in fluid communication with the second outlet to receive the first dehalogenated pyrolysis oil 208. The reactor has a third inlet to receive therethrough the water 212. The reactor 210 is equipped with a mixing element configured to mix the first dehalogenated pyrolysis oil 208 and the water 212. The reactor 210 has a third outlet to discharge the mixture 216 of the first dehalogenated pyrolysis oil and water to a separator 220. The separator 220 is equipped with a fourth inlet, a fifth outlet, a sixth outlet. The separator 220 has a fourth inlet connected to and in fluid communication with the third outlet to receive the mixture 216 of the first dehalogenated pyrolysis oil and water. The separator 220 being operated to separate the mixture 216 of the first dehalogenated pyrolysis oil and water to produce a halogen-enriched water stream 218 and a second dehalogenated pyrolysis oil 222. The second dehalogenated pyrolysis oil 222 contains at least twenty weight percent less of the halogenated contaminants as compared to the first dehalogenated pyrolysis oil.

In certain embodiments, the system also includes a halogen scrubbing unit to process the halogen-enriched inert gas stream 206. The halogen scrubbing unit is operated to remove halogenated contaminants and recover hydrocarbons. The halogen contaminants are removed from the halogen-enriched inert gas stream 206 by absorption. The halogen scrubbing unit is operated to recover hydrocarbons from the halogen-enriched inert gas stream 206. The halogen scrubbing unit has a fourth outlet to recycle the recovered hydrocarbons to the storage vessel 202.

In certain embodiments, the system also includes an adsorbent-containing unit with a seventh inlet. The seventh inlet is connected to and in fluid communication with the fifth outlet to receive the second dehalogenated pyrolysis oil 222. The adsorbent-containing unit is operated to remove the halogenated contaminants from the second dehalogenated pyrolysis oil 222. The adsorbent-containing unit produces a substantially halogen-free pyrolysis oil. In certain embodiments, the adsorbent is an activated carbon, an aluminosilicate, a solid acid, or a cationic exchange resin.

In certain embodiments, the system also includes a water treatment unit with an eighth inlet and a seventh outlet. The eighth inlet is connected to and in fluid communication with the sixth outlet to receive the halogen-enriched water stream 218 from the separator 220. The water treatment unit is operated to remove the halogenated contaminants from the halogen-enriched water 218. The water treatment unit produces a substantially halogen-free water stream. In certain embodiments, the water treatment unit has a seventh outlet to discharge the substantially halogen-free water to the reactor 210. The reactor 210 has a ninth inlet to receive and recycle the substantially halogen-free water stream.

Figure 3:
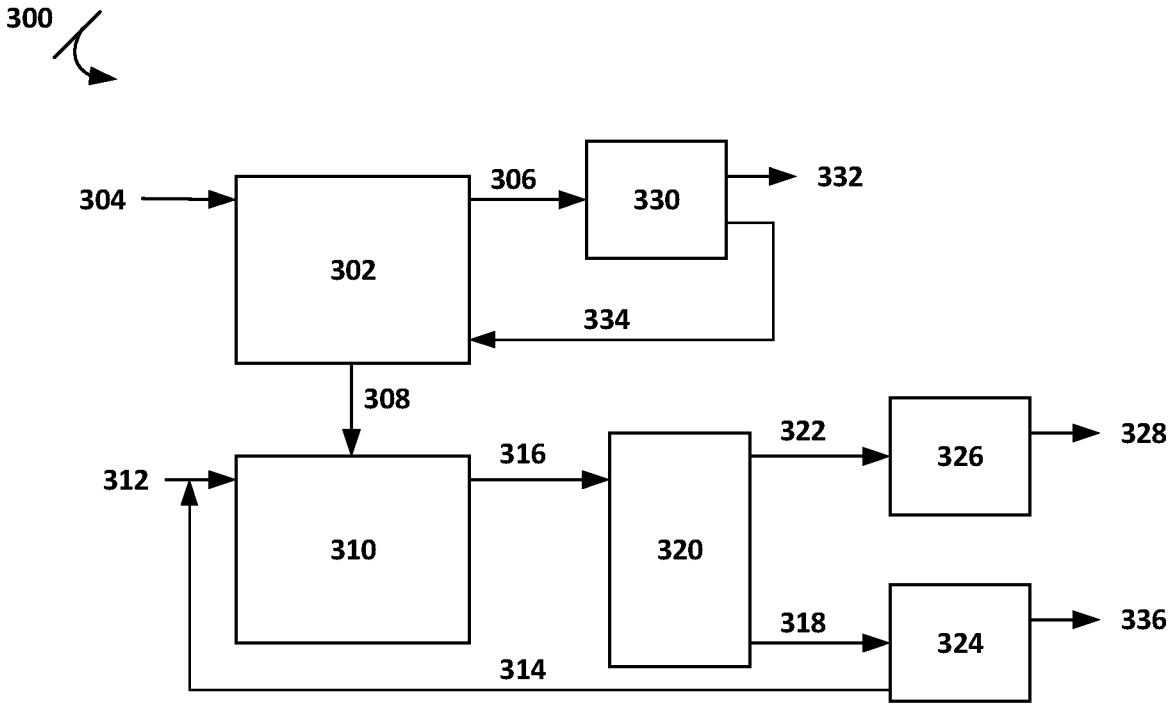
FIG. 3 is a diagrammatic representation of a system to treat pyrolysis oil containing halogenated contaminants, which includes a storage vessel, a reactor, a separator, a halogen scrubbing unit, and an adsorbent-containing unit to produce a substantially halogen-free pyrolysis oil.

Embodiments also include systems of treating pyrolysis oil to remove halogenated contaminants. FIG. 3 is a diagrammatic representation of a system 300 to treat halogen contaminated pyrolysis oil. This system 300 includes a storage vessel 302 equipped to receive an inert gas stream 304 and a halogenated pyrolysis oil. The storage vessel 302 has a first inlet, a first outlet, a second outlet, and a sixth inlet. The storage vessel 302 has a first inlet to receive therethrough the inert gas stream 304. The first inlet of the storage vessel 302 can be positioned to pass the inert gas stream 304 through the headspace above the pyrolysis oil liquid. The first inlet of the storage vessel 302 can be positioned to bubble the inert gas stream 304 through pyrolysis oil liquid. The storage vessel 302 is maintained at ambient temperature. The storage vessel 302 has a first outlet to discharge the halogen-enriched inert gas stream 306. The storage vessel 302 has a second outlet to discharge the first dehalogenated pyrolysis oil 308 to a reactor 310. The first dehalogenated pyrolysis oil 308 contains at least twenty weight percent less of the halogenated contaminants as compared to the unstripped contaminated pyrolysis oil. In certain embodiments, the storage vessel 302 is maintained at ambient temperature. The reactor 310 has a second inlet, a third inlet, a third outlet, and a ninth inlet. The reactor 310 has a second inlet connected to and in fluid communication with the second outlet to receive the first dehalogenated pyrolysis oil 308. The reactor 310 has a third inlet to receive therethrough the water 312. The reactor 310 is equipped with a mixing element configured to mix the first dehalogenated pyrolysis oil 308 and the water 312. The reactor 310 has a third outlet to discharge the mixture 316 of the first dehalogenated pyrolysis oil and water to a separator 320. The separator 320 is equipped with a fourth inlet, a fifth outlet, and a sixth outlet. The fourth inlet of the separator 320 is connected to and in fluid communication with the third outlet to receive the mixture 316 of the first dehalogenated pyrolysis oil and water. The separator 320 is operated to separate the mixture 316 of the first dehalogenated pyrolysis oil and water to produce a halogen-enriched water stream 318 and a second dehalogenated pyrolysis oil 322. The second dehalogenated pyrolysis oil 322 contains at least twenty weight percent less of the halogenated contaminants as compared to the first dehalogenated pyrolysis oil 308.

In certain embodiments, the system also includes a halogen scrubbing unit 330 having a fifth inlet and a fourth outlet. The fifth inlet of the halogen scrubbing unit 330 is connected to and in fluid communication with the first outlet of the storage vessel 302 to receive the halogen enriched inert gas stream 306. The halogen scrubbing unit 330 is operated to remove the halogenated contaminants 332 from the halogen-enriched inert gas stream 306 by absorption. The halogen scrubbing unit 330 is also operated to recover hydrocarbons from the halogen-enriched inert gas stream 306. The fourth outlet of the halogen scrubbing unit 330 is connected to and in fluid communication with the sixth inlet of the storage vessel 302 to recycle the recovered hydrocarbons 334 to the storage vessel 302.

In certain embodiments, the system also includes an adsorbent-containing unit 326 with a seventh inlet. The seventh inlet is connected to and in fluid communication with the fifth outlet to receive the second dehalogenated pyrolysis oil 322 from the separator 320. The adsorbent-containing unit 326 is operated to remove the halogenated contaminants 336 from the second dehalogenated pyrolysis oil 322. The adsorbent-containing unit 326 produces a substantially halogen-free pyrolysis oil 328. In certain embodiments, the adsorbent is an activated carbon, an aluminosilicate, a solid acid, or a cationic exchange resin.

In certain embodiments, the system also includes a water treatment unit 324 having an eighth inlet and a seventh outlet. The eighth inlet is connected to and in fluid communication with the sixth outlet to receive the halogen-enriched water stream 318 from the separator 320. The water treatment unit 324 is operated to remove the halogenated and other contaminants (nitrogen, oxygen, hydrocarbon) from the halogen-enriched water 318. The water treatment unit 324 is operated to produce a substantially halogen-free water stream 314. In certain embodiments, the substantially halogen-free water stream 314 can be recycled back to the reactor 310. The reactor has a ninth inlet that is connected to and in fluid communication with the seventh outlet to receive the substantially halogen-free water stream 314.

Figure 4A:
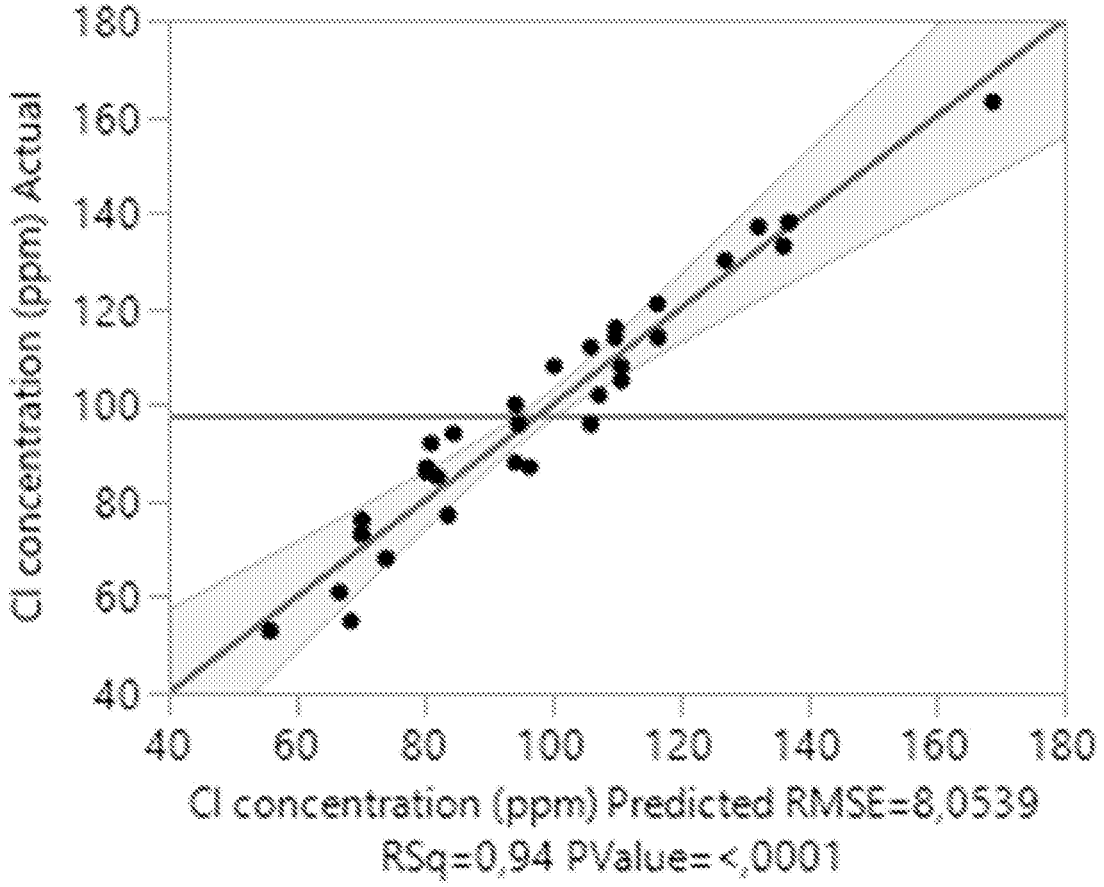
FIG. 4A is a graphical representation of the root mean square error (RMSE) of predicted versus actual results of organic chloride removal from pyrolysis oil by various techniques, including nitrogen stripping, water washing, and nitrogen stripping combined with water washing.
Figure 4B:
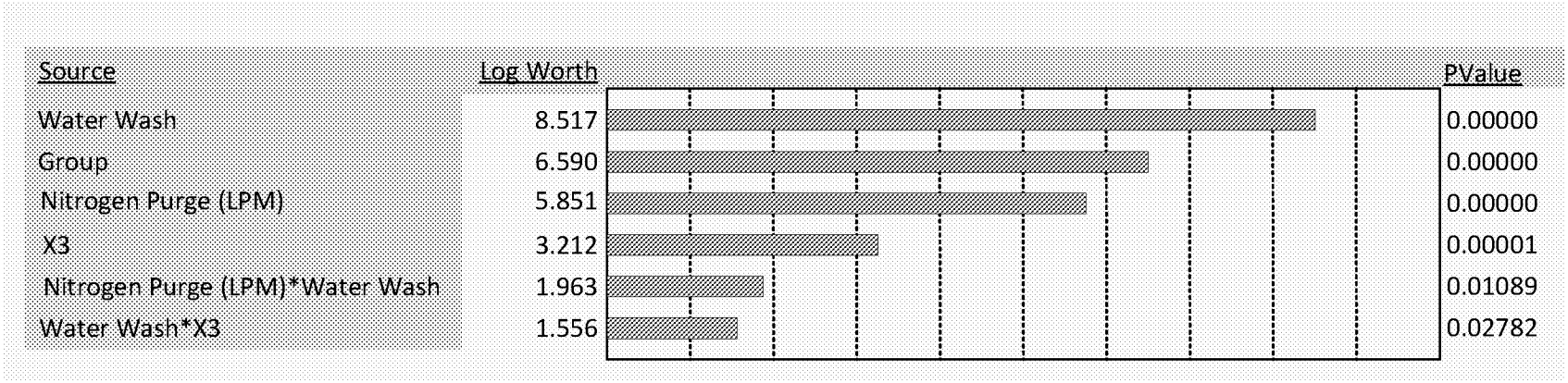
FIG. 4B is a tabular representation of the relative probabilities that the observed values of the organic chloride stripping of pyrolysis oil by various techniques, including nitrogen stripping, water washing, and nitrogen stripping combined with water washing are more or less likely.

In certain embodiments, a nitrogen purge along with a water wash have strongest impact for organic Cl removal from the pyrolysis oil. FIG. 4A. is a graphical representation of the root mean squared error (RMSE) of the actual organic Cl concentration (ppm) versus the organic predicted Cl concentration (ppm) from a Design of Experiments (DOE) model. The predictive accuracy of the model is described by the root squared (RSq) value of 0.94. A RSq value of greater than 0.85 is considered to indicate a high degree of predictive accuracy. The error between the predicted values and actual values is described by the RMSE of 8.0539. A RSME value below 10 is considered to indicate a good model. The statistical significance of a parameter being tested by the model is described by the p value of <0.0001. A p value of less than 0.05 is considered statistically significant and more likely to occur or not to occur. FIG. 4B is a table of parameters tested in the DOE model and their statistical significance as described by the p value and the log worth. The log worth is the negative log 10 of the p value. The table shows that all three factors-water wash, nitrogen purge and use of an adsorbent work in combination to decrease chloride content. The combination of these methods leads to a stronger decrease of chloride as the interactions factors are significant.

Figure 5A:
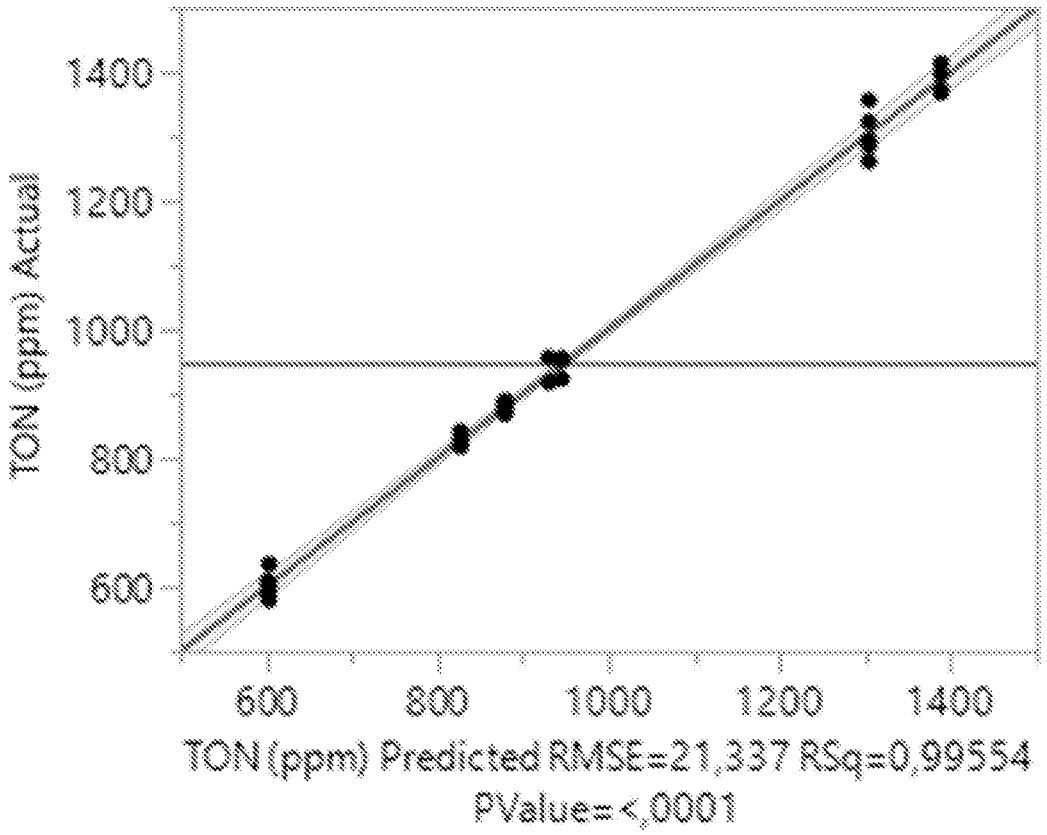
FIG. 5A is a graphical representation of the root mean square error (RMSE) of predicted versus actual results of organic nitrogen compound removal from pyrolysis oil by adsorbent media X3, water washing, and water washing combined with adsorbent media.

In certain embodiments, use of an adsorbent along with a water wash have significant effects on removal of organic nitrogen compounds from pyrolysis oil. FIG. 5A is a graphical representation of the root mean squared error (RMSE) of the actual organic nitrogen compound concentration (ppm) versus the predicted organic nitrogen compound concentration (ppm) from a Design of Experiments (DOE) model. The predictive accuracy of the model is described by the root squared (RSq) value of 0.99554. A RSq value of greater than 0.85 is considered to indicate a high degree of predictive accuracy. The error between the predicted values and actual values is described by the RMSE of 21.337. A RSME value below 30 is considered to indicate a fair model. The statistical significance of a parameter being tested by the model is described by the p value of <0.0001. A p value of less than 0.05 is considered statistically significant for an event to occur or not to occur.

Figure 5B:
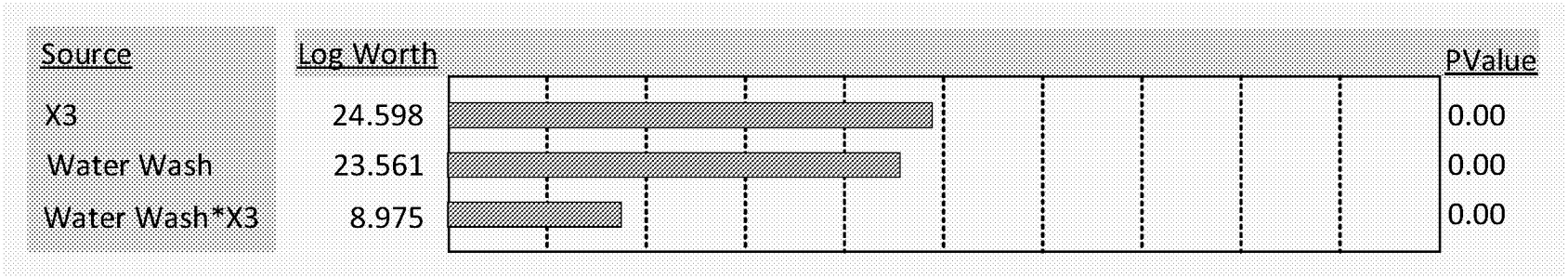
FIG. 5B is a tabular representation of the relative probabilities that the observed values of the organic nitrogen compound removal from pyrolysis oil by various adsorbent media X3, water washing, and water washing combined with adsorbent media are more or less likely.

FIG. 5B is a table of parameters tested in the DOE model and their statistical significance as described by the p value and the log worth. The log worth is the negative log 10 of the p value. The table results indicate that adsorbent and water wash have the main effect on organic nitrogen compound removal. Nitrogen purge has no impact on organic nitrogen compound concentration. A combination of water wash and adsorbent is efficient to further decrease organic nitrogen compound concentration in the pyrolysis oil.

EXAMPLES

Example 1

Pyrolysis oil was subjected to a flow of nitrogen to remove chloride contaminants. A sample of pyrolysis oil, 20 to 150 mL, was placed in a testing vial equipped with a gas purge line capable of a range of nitrogen flow rates of between zero and two liters per minute (LPM). The testing vials were sparged with a flow of nitrogen, with the sparge gas being condensed in a condenser and collected for analysis. The purge of nitrogen was maintained for two hours. The testing vials were sealed after the two-hour period and analyzed for chloride content. Chloride analysis was performed according to the UOP 779 protocol. The chloride concentration values of the condensate samples were compared to the original sample to determine a percent enrichment of chloride in the condensate indicative of selective removal of chloride by nitrogen sparging.

TABLE 1

| Nitrogen Flow, LPM | Chloride Removal in Test Vial After Two Hours, % | Condensate Volume, mL | Condensate Chloride Enrichment, % (compared to original sample) | Condensate Losses Unrecovered Pyrolysis Oil, mL |
|---|---|---|---|---|
| 1.57 | 50.1 | 5 | 845 | 8 |
| 0.79 | 31.2 | 4 | 595 | 3 |
| 0.10 | 0 | 0 | 0 | 1 |
| 0 | — | — | — | — |

Other objects, features and advantages of the disclosure will become apparent from the foregoing figures, detailed description, and examples. It should be understood, however, that the figures, detailed description, and examples, while indicating specific embodiments of the disclosure, are given by way of illustration only and are not meant to be limiting. Additionally, it is contemplated that changes and modifications within the spirit and scope of the disclosure will become apparent to those skilled in the art from the detailed description. In further embodiments, features from specific embodiments may be combined with features from other embodiments. For example, features from one embodiment may be combined with features from any of the other embodiments. In further embodiments, additional features may be added to the specific embodiments described herein.

What is claimed is:

1. A method of treating a pyrolysis oil to remove halogenated contaminants, the method comprising:

supplying an inert gas stream to a storage vessel containing a pyrolysis oil with halogenated contaminants while the storage vessel is maintained at ambient temperatures to produce a halogen-enriched inert gas stream and a first dehalogenated pyrolysis oil containing at least twenty weight percent less of the halogenated contaminants as compared to the pyrolysis oil, wherein the halogenated contaminants include organic chloride contaminants;

conveying the first dehalogenated pyrolysis oil and water to a reactor equipped with a mixing element;

mixing the first dehalogenated pyrolysis oil and water in the reactor to produce a halogen-enriched water stream and a second dehalogenated pyrolysis oil containing at least twenty weight percent less of the halogenated contaminants as compared to the first dehalogenated pyrolysis oil; and separating the halogen-enriched water stream from the second dehalogenated pyrolysis oil to produce a substantially halogen-free pyrolysis oil.

2. The method of claim 1, wherein the inert gas stream consists of nitrogen, argon, helium, or combinations thereof.

3. The method of claim 1, wherein the inert gas stream is supplied to a headspace above the pyrolysis oil in the storage vessel.

4. The method of claim 1, wherein the inert gas stream is bubbled through the pyrolysis oil in the storage vessel.

5. The method of claim 1, further comprising the step of:

conveying the halogen-enriched inert gas stream to a halogen scrubbing unit to remove the halogenated contaminants by absorption.

6. The method of claim 5, further comprising the steps of:

recovering hydrocarbons present in the halogen-enriched inert gas stream; and recycling the hydrocarbons to the storage vessel containing the pyrolysis oil.

7. The method of claim 1, further comprising the steps of:

supplying the halogen-enriched water stream to a water treatment unit to remove the halogenated contaminants and produce a substantially halogen-free water stream; and recycling the substantially halogen-free water stream to the reactor.

8. The method of claim 1, wherein after separating the second dehalogenated pyrolysis oil from the halogen-enriched water stream, the second dehalogenated pyrolysis oil is contacted with an adsorbent to produce the substantially halogen-free pyrolysis oil.

9. The method of claim 8, wherein the adsorbent comprises an activated carbon, an aluminosilicate, a solid acid, or a cationic exchange resin.

10. The method of claim 1, wherein the pyrolysis oil is treated in the absence of any catalyst.

11. A system for treating a pyrolysis oil to remove halogenated contaminants, the system comprising:

a storage vessel containing a pyrolysis oil with halogenated contaminants maintained at ambient temperatures and equipped with a first inlet for receiving an inert gas stream, a first outlet for discharging a halogen-enriched inert gas stream, and a second outlet connected to and in fluid communication with a second inlet of a reactor, the halogen-enriched inert gas stream being produced along with a first dehalogenated pyrolysis oil from interactions between the inert gas stream and the pyrolysis oil, and the first dehalogenated pyrolysis oil containing at least twenty weight percent less of the halogenated contaminants as compared to the pyrolysis oil, wherein the halogenated contaminants include organic chloride contaminants;

the reactor equipped with the second inlet to receive the first dehalogenated pyrolysis oil, a third inlet to receive water, a mixing element to mix the first dehalogenated pyrolysis oil and the water, and a third outlet connected to and in fluid communication with a fourth inlet of a separator; and the separator equipped with the fourth inlet to receive a mixture of the first dehalogenated pyrolysis oil and the water from the third outlet, the separator being operated to separate the mixture of the first dehalogenated pyrolysis oil and the water to produce a halogen-enriched water stream and a second dehalogenated pyrolysis oil containing at least twenty weight percent less of the halogenated contaminants as compared to the first dehalogenated pyrolysis oil.

12. The system of claim 11, wherein the inert gas stream consists of nitrogen, argon, helium, or combinations thereof.

13. The system of claim 11, wherein the first inlet is positioned in the storage vessel to receive the inert gas stream at a headspace above the pyrolysis oil in the storage vessel.

14. The system of claim 11, wherein the first inlet is positioned proximal to a floor of the storage vessel to pass the inert gas stream through the pyrolysis oil in the storage vessel.

15. The system of claim 11, further comprising:

a halogen scrubbing unit equipped with a fifth inlet connected to and in fluid communication with the first outlet of the storage vessel to receive the halogen-enriched inert gas stream, the halogen scrubbing unit being operated to remove the halogenated contaminants from the halogen-enriched inert gas stream by absorption.

16. The system of claim 15, wherein the halogen scrubbing unit is operated to recover hydrocarbons present in the halogen-enriched inert gas stream.

17. The system of claim 16, wherein the halogen scrubbing unit is equipped with a fourth outlet connected to and in fluid communication with a sixth inlet of the storage vessel to deliver the recovered hydrocarbons to the storage vessel containing the pyrolysis oil.

18. The system of claim 11, further comprising:

an adsorbent-containing unit with a seventh inlet connected to and in fluid communication with a fifth outlet of the separator, the adsorbent-containing unit being operated to remove the halogenated contaminants from the second dehalogenated pyrolysis oil, the halogenated contaminants being adsorbed by the adsorbent to produce a substantially halogen-free pyrolysis oil.

19. The system of claim 11, further comprising:

a water treatment unit with an eighth inlet connected to and in fluid communication with a sixth outlet of the separator, the water treatment unit being operated to remove the halogenated contaminants from the halogen-enriched water stream and produce a substantially halogen-free water stream.

20. The system of claim 19, wherein the water treatment unit has a seventh outlet connected to and in fluid communication with a ninth inlet of the reactor to recycle the substantially halogen-free water stream to the reactor.

* * * * *